United States Patent [19]

Peterson

[11] Patent Number: 4,569,004

[45] Date of Patent: Feb. 4, 1986

[54] COVE LIGHT FIXTURE

[76] Inventor: William A. Peterson, 277 Birch Dr., Muskegon, Mich. 49445

[21] Appl. No.: 651,255

[22] Filed: Sep. 17, 1984

[51] Int. Cl.[4] ..... F21S 5/00

[52] U.S. Cl. ..... 362/216; 362/219; 362/263; 362/346

[58] Field of Search ..... 362/263, 296, 344, 346, 362/219, 216

[56] References Cited

U.S. PATENT DOCUMENTS

| | | | |
|---|---|---|---|
| D. 128,049 | 7/1941 | Kurtz et al. | 262/219 |
| 974,090 | 10/1910 | O'Brien . | |
| 1,817,543 | 8/1931 | Ciraolo . | |
| 1,854,357 | 4/1932 | Wiley | 362/216 |
| 2,284,363 | 5/1942 | Boomsma | 362/216 |
| 2,357,057 | 8/1944 | Owen . | |
| 2,501,485 | 3/1950 | Tuck | 362/219 |
| 2,543,713 | 2/1951 | Yeager | 362/216 |
| 2,623,988 | 12/1952 | Brown | 362/216 |
| 2,629,814 | 2/1953 | Brown | 362/216 |
| 3,040,169 | 6/1962 | Lester | 362/216 |

FOREIGN PATENT DOCUMENTS

| | | | |
|---|---|---|---|
| 718270 | 11/1954 | United Kingdom | 362/219 |

*Primary Examiner*—Ira S. Lazarus

*Attorney, Agent, or Firm*—Price, Heneveld, Huizenga & Cooper

[57] ABSTRACT

The specification discloses a neon light fixture for use in ceiling coves to provide indirect decorative lighting. The fixture includes a channel-shaped housing having a pair of snap-fit sockets, a C-shaped neon tube snap-fitted within the sockets, and a reflector/cover removably mounted on the housing between the body of the tube and the housing.

10 Claims, 5 Drawing Figures

COVE LIGHT FIXTURE

BACKGROUND OF THE INVENTION

The present invention relates to light fixtures, and more particularly to neon light fixtures.

A wide variety of fixtures has been developed to provide decorative neon lighting. The glass neon tubes supported within the fixtures include electrodes extending from either end thereof, which electrodes are coupled to high-voltage low-current power sources.

Often, neon lighting is installed in ceiling covers to provide indirect decorative lighting. Usually the tubes are simply laid in the coves and jumpered together, leaving the electrical connections exposed. In view of the high voltages involved, this is extremely dangerous to maintenance people accessing the cove, for example for cleaning or maintenance. A worker contacting one of the connections can receive an injurious shock.

Although attempts have been made to enclose the electrode connections, these structures are not without their drawbacks. One fixture, disclosed in U.S. Pat. No. 1,817,543, issued Aug. 4, 1931, to Ciraolo, entitled ELECTRODE BOX, includes an electrode box having a supporting member to support a neon tube within the box. The electrode wire extending from the tube end is jumpered after the tube is mounted within the box, which is a time-consuming connection not easily altered. The boxes are spaced one from the other with the neon tubes extending therebetween. The fixture makes relatively inefficient use of the light emitted from the tube.

Another fixture, disclosed in U.S. Pat. No. 1,854,357, issued Apr. 19, 1932, to Wiley, entitled ELECTROLUMINESCENT TUBE, includes a housing packed with a filling material which encapsulates the electrical connections at the tube ends. The neon tube is not readily removable from the fixture. The fixture further includes a pair of angle strips which extend the full length of the fixture and meet longitudinally under the light tube to cover the filling. The angle strips are relatively easily dislodged from the fixture.

SUMMARY OF THE INVENTION

The aforementioned problems are overcome in the present invention providing a neon light fixture which is safe, functional, and relatively inexpensive. More particularly, the fixture includes (1) a trough-shaped housing having a pair of quick-connect terminals, (2) a C-shaped light tube including an elongated body portion located outside the housing and a pair of curved ends extending into the housing and releasably received within the quick-connect terminals, and (3) a pair of reflector cover halves covering the housing and located between the tube and the housing.

The present fixture is safe because all electrical connections at the light tube ends are enclosed within the housing. Maintenance workers therefore receive improved protection from accidental shock when servicing the ceiling cove and/or light fixtures therein.

Further, the structure of the present fixture facilitates installation and subsequent replacement of neon tubes within the fixture. To replace a tube, the cover is removed from the housing; the old tube is removed from the quick-connect terminals; the new tube is mounted within the quick-connect terminals; and the cover is replaced. The necessity of jumpering electrode wires is eliminated. Consequently, bulbs can be changed easily to provide variations in color and/or intensities or to replace nonfunctional tubes.

In a preferred aspect of the invention, the cover is at least partially reflective to improve the lighting efficiency of the fixture.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 3:
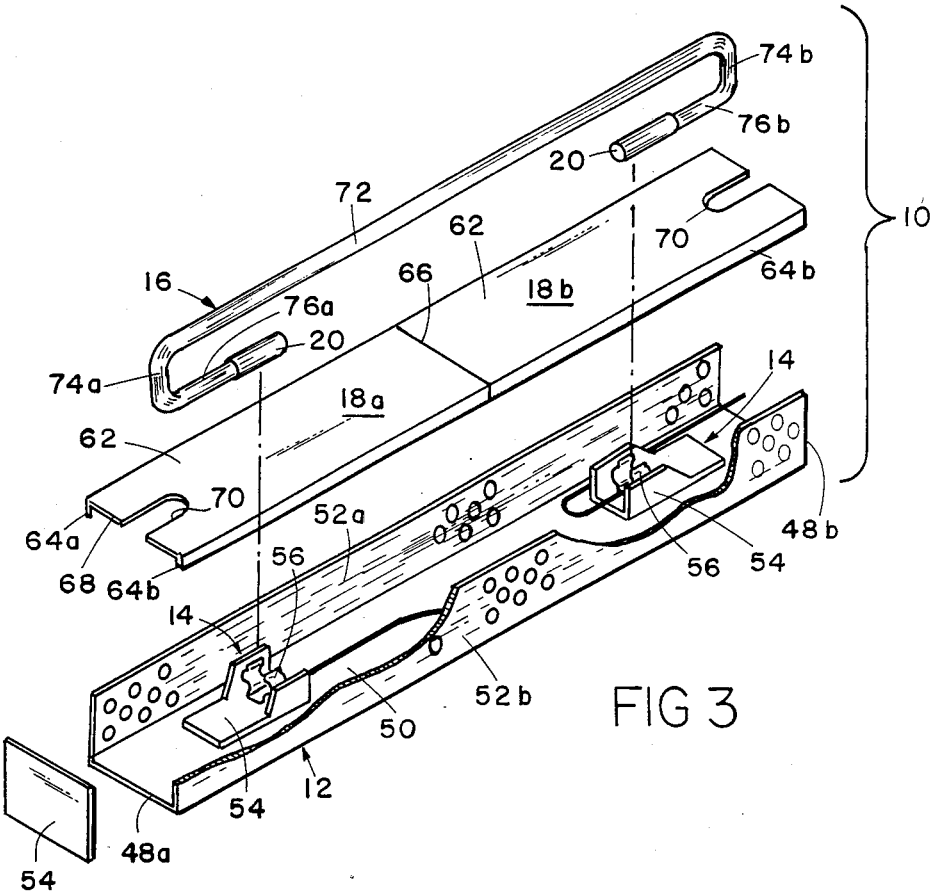
FIG. 3 is a perspective exploded view of the light fixture.

A light fixture constructed in accordance with a preferred aspect of the invention is illustrated in FIG. 3 and generally designated 10. The fixture includes trough-shaped housing 12, a pair of terminal clips 14 mounted therein, neon light tube 16, and a pair of cover halves 18*a* and 18*b*. The neon tube includes a pair of brass caps 20 on the terminal ends thereof which snap-fit within terminal cips 14. Covers 18*a* and 18*b* are removably mounted on housing 12 between light tube 16 and the housing to serve as a reflector for the light tube and to enclose the electrical connections within the housing.

Figure 1:
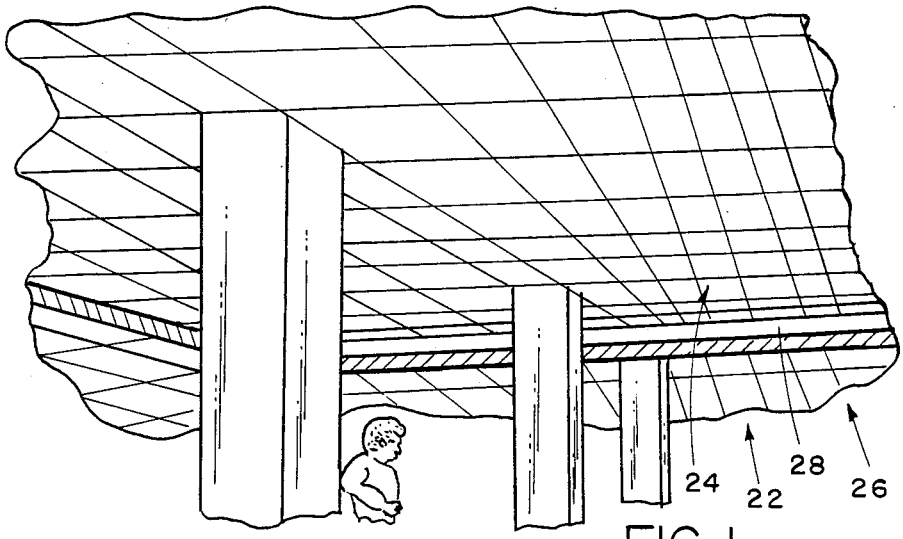
FIG. 1 is a fragmentary perspective view of a retail store ceiling cove in which the light fixture of the present invention is located.
Figure 2:
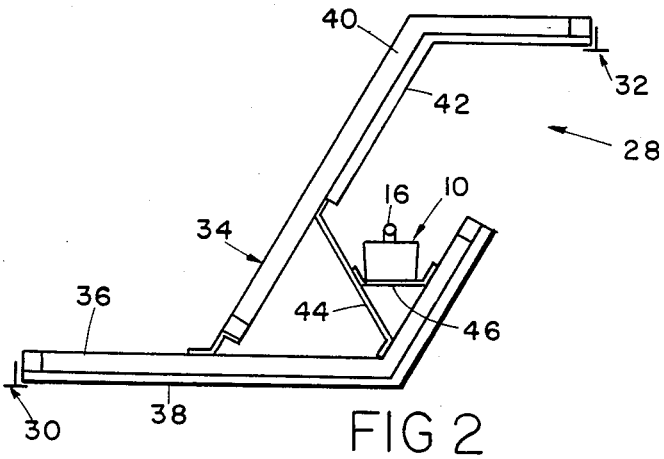
FIG. 2 is a sectional view through the ceiling cove and light fixture.

Retain store ceiling 22 (FIG. 1) in which fixture 10 is used includes upper portion 24, lower portion 26, and cove 28 at the junction of the upper and lower portions. Cove 28 (FIG. 2) is supported between ceiling grid T 30 of lower ceiling 26 and ceiling grid 32 of upper ceiling 24. The cove includes structural frame 34 extending between ceiling grids 30 and 32. Lower frame portion 36 is faced with material 38 to match the lower ceiling, while upper frame 40 is surfaced with ceiling material 42 to match the upper ceiling. Upper and lower frames 36 and 40 are fabricated of one-inch square tubing of eighteen-gauge cold-rolled steel. Light mounting straps 44 of one-eighth inch by three-quarters inch cold-rolled steel extend between the lower and upper frames, and light support straps 46 of sixteen-gauge by three-quarters inch cold-rolled steel extend between the lower frame and the light mounting strap to support fixtures 10. The fixtures provide indirect lighting which is reflected off ceiling material 42.

Figure 4:
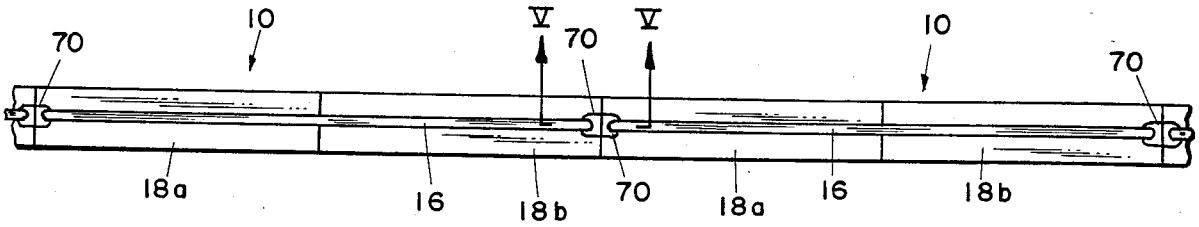
FIG. 4 is a top plan view of a plurality of light fixtures arranged end-to-end.

Housing 12 (FIGS. 3 and 5) is generally trough-shaped or channel-shaped throughout its length including a pair of opposite ends 48*a* and 48*b*. The housing includes floor 50 and a pair of opposite sidewalls 52*a* and 52*b* extending upwardly therefrom and generally perpendicular thereto. In the preferred embodiment, the housing is a Type-C housing sold by Panduit under the trademark PANDUCT. The preferred housing includes perforated sidewalls 52 which facilitate heat dissipation. End cap 54 is mounted on either end 48 of housing 12 as necessary to enclose the electrical connections. When housings 12 are arranged end-to-end (see also FIG. 4), end caps 54 are omitted.

Terminal clips 14 (FIGS. 3 and 5) are secured to housing floor 50 of housing 12 generally proximate the opposite ends 48 thereof. Each spring clip includes a polymeric body 54 and a conductive metallic bifurcated spring clip 56 supported therein. Each of spring clips 56 includes screw connection 58 enabling power cable 60 to be coupled thereto. In the preferred embodiment, each clip 14 is one-half of a fuse block such as that sold by Marathon Electric under the trademark COOL CLIP. A suitable power source (not shown) is provided to supply 15,000 volts of power at 30 milliamps via fourteen-gauge cables 60 coupled to the spring clips. Preferably cables 60 are tied to housing 12 using the upper row of holes in sidewalls 52. The output of the voltage source may vary depending on the length, diameter, and color of the tubes.

Figure 5:
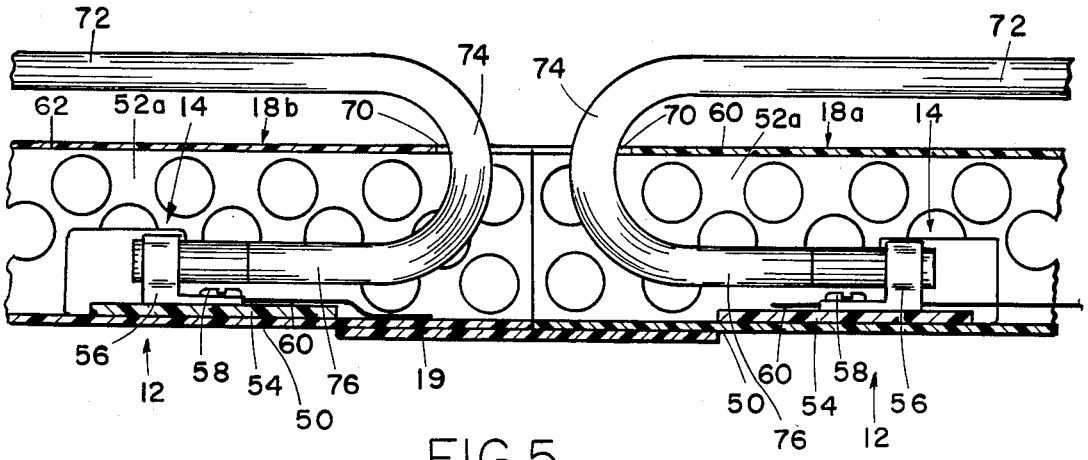
FIG. 5 is a sectional view taken along plane V—V in FIG. 4.

Cover halves 18*a* and 18*b* are generally identical to one another (FIGS. 3 and 5). Each of the covers includes planar body portion 62 and a pair of lips 64*a* and 64*b* extending downwardly therefrom along the opposite edges thereof. The distance between lips 64 is approximately the same as the distance between housing sides 52 such that the lips closely receive the housing sides therebetween when the covers are positioned on the housing. Each cover half 18 further includes generally linear end 66 and opposite end 68 including notch or cutout 70 therein to receive neon tubes 16. The length of cover halves 18*a* and 18*b* together is substantially the same length as housing 12. The cover halves abut one another along edges 66 which form a line transverse to housing 12 and light tube 16. Covers 18 are at least partially reflective to reflect light from tube 16. In the preferred embodiment, the cover is a plastc, Type-D cover. The color of the cover can be varied to alter the aesthetic effect of the light. Adjacent housings 12 are interconnected using a section 19 of a cover half inverted and interfitted under the housings (FIG. 5).

Neon tube 16 (FIG. 3) is generally C-shaped including a generally linear or elongated body 72 and a pair of opposite curved ends 74*a* and 74*b*. Preferably, tube 16 is fifteen millimeters in diameter. The tube ends extend from body 72 in generally a common direction and include terminal end portions 76*a* and 76*b* oriented toward one another. Brass conductive caps 20 are mounted on terminal ends 76 and electrically contact the terminal wire extending from the neon tube. Caps 20 per se are known by those having ordinary skill in the art as a protective device for the relatively fragile terminal wires. Caps 20 are generally cylindrical and dimensioned to snap-fit within spring clips 56 in housing 12 to be releasably mounted therein.

ASSEMBLY AND OPERATION

Light fixtures 10 are positioned within cove 28 (FIG. 2) resting on spaced light support straps 46. Preferably, a plurality of fixtures 10 are arranged end-to-end (FIG. 4) such that the tubes 16 of adjacent fixtures define a substantially continuous light bar. Suitable power supplies (not shown) are electrically coupled to fixtures 10 to provide the 15,000 volt, 30 milliamp power. Tubes 16 are snap-fitted within housing 12 by snapping caps 20 of the tubes into spring clips 56 of terminal connectors 14. When so installed, body 72 of tube 16 is located outside housing 12 (FIG. 5), while curved ends 74 extend into the housing. Cover halves 18*a* and 18*b* are mounted on housing 12 after tubes 16 are installed therein. Each cutout 70 is interfitted with curved tube end 74, and cover half 18 is positioned on housing 12 with lips 64 extending about housing sides 52. When so installed, the electrical connections within housing 12 are enclosed to prevent accidental shock to maintenance people having access to the cove, for example during cleaning or maintenance. Additionally, covers 18 provide a reflective surface for the light tubes to increase the light provided by fixtures 10. When arranged in end-to-end fashion (FIG. 4) the light bars which extend substantially from end-to-end of each fixture to be closely proximate one another define an apparently continuous light bar when viewed indirectly from the store floor.

The above description is that of a preferred embodiment of the invention. Various changes and alterations can be made without departing from the spirit and broader aspects of the invention as defined in the appended claims, which are to be interpreted in accordance with the principles of patent law, including the doctrine of equivalents.

The embodiments of the invention in which an exclusive property or privilege is claimed are defined as follows:

1. A neon light fixture comprising:

a C-shaped neon tube including a linear body and a pair of opposite ends curved from said body in a common direction, each of said ends including a conductive cap mounted thereon;

a trough-shaped housing having an open interior and including a floor and a pair of opposite sidewalls extending therefrom, said housing further including a pair of spring clips mounted on said housing floor releasably receiving said tube caps, said tube body being located outside said housing when said tube caps are snap-fitted within said spring clips; and reflective cover means for covering said trough-shaped housing between said tube linear body and said housing, said cover means including cutouts permitting said tube curved ends to extend through said cover means and into said housing, said cover means comprising a pair of cover halves each defining one of said cutouts, said cover halves abutting one another between said tube ends along a line generally transverse to said tube body.

2. A neon light fixture as defined in claim 1 wherein said housing includes opposite ends, and further wherein said curved tube ends extend through said cover means adjacent said housing ends, whereby a plurality of fixtures can be arranged end-to-end to define a substantially continuous light bar.

3. A light fixture comprising:

a trough-shaped housing having an open side and including a pair of connectors mounted within said housing;

a light tube including a body portion and a pair of ends extending therefrom, said ends being releasably received within said connectors, said body portion being located outside of said trough-shaped housing when said tube ends are received within said connectors; and cover means releasably received on said open housing side for covering said housing and the connectors therein, said cover means being located between said housing and said tube body portion, said tube ends extending from said tube body portion on one side of said cover means to said connectors on the other side of said cover means.

4. A light fixture comprising:

a channel-shaped housing including first and second ends and a pair of terminal connectors mounted within said housing generally proximate said first and second ends;

a light tube including an elongated body and a pair of ends extending from said body in a common direction, each of said ends including a conductive portion, said ends being releasably mounted within said terminal connectors, said tube body being located outside said channel-shaped housing when said tube ends are mounted therein; and removable cover means on said housing between said tube body and said housing for covering said housing and defining cutout means for permitting said tube ends to extend through said cover means.

5. A light fixture as defined in claim 4 wherein said cover means is at least partially reflective to improve luminescence from said fixture.

6. A light fixture as defined in claim 4 wherein the interior of said housing is substantially unobstructed to facilitate access to said terminal connectors.

7. A light fixture as defined in claim 4 wherein each conductive portion includes a conductive cap mounted on the tube end to facilitate electrical interconnection of said conductive portion and said terminal connector.

8. A light fixture as defined in claim 7 wherein each terminal connector comprises a spring clip such that each cap snap-fits within its associated terminal connector.

9. A light fixture as defined in claim 4 wherein said cover means includes a pair of cover halves meeting along a line generally transverse to said tube body.

10. A light fixture as defined in claim 9 wherein said housing includes opposite ends, and further wherein said tube extends through said cover means proximate said ends, whereby a plurality of said fixtures can be arranged end-to-end with said tubes forming a substantially continuous light bar.

* * * * *